US011732456B2

(12) United States Patent
Griffith

(10) Patent No.: US 11,732,456 B2
(45) Date of Patent: Aug. 22, 2023

(54) TOILET SPLASH GUARD

(71) Applicant: Robert Griffith, Mesa, AZ (US)

(72) Inventor: Robert Griffith, Mesa, AZ (US)

( * ) Notice: Subject to any disclaimer, the term of this patent is extended or adjusted under 35 U.S.C. 154(b) by 0 days.

(21) Appl. No.: 17/717,102

(22) Filed: Apr. 10, 2022

(65) Prior Publication Data

US 2022/0325513 A1 Oct. 13, 2022

Related U.S. Application Data

(60) Provisional application No. 63/172,884, filed on Apr. 9, 2021.

(51) Int. Cl.
*E03D 9/00* (2006.01)
*A47K 13/24* (2006.01)

(52) U.S. Cl.
CPC ..... *E03D 9/00* (2013.01); *A47K 13/24* (2013.01)

(58) Field of Classification Search
CPC ..... E03D 9/00; A47K 13/24
See application file for complete search history.

(56) References Cited

U.S. PATENT DOCUMENTS

| | | | | |
|---|---|---|---|---|
| 5,625,905 | A * | 5/1997 | Woods | E03D 9/00 4/300.3 |
| 5,732,416 | A * | 3/1998 | Albert | A47K 13/24 4/300.3 |
| 5,943,707 | A * | 8/1999 | Bergenwall | A47K 13/24 4/300.3 |
| D523,127 | S * | 6/2006 | Sublett | D23/310 |
| 9,809,967 | B1 * | 11/2017 | Conrad | A47K 13/24 |
| D809,637 | S * | 2/2018 | Yamashita | D23/311 |
| 2016/0369488 | A1 * | 12/2016 | Todd, IV | E03D 9/00 |

* cited by examiner

*Primary Examiner* — Christine J Skubinna
(74) *Attorney, Agent, or Firm* — Morgan Law Offices, PLC

(57) ABSTRACT

A toilet splash guard collects errant urine from a male urinating in an upright position. The toilet splash guard attaches toward the rear of a toilet bowl between the toilet seat and the bowl. The toilet splash guard has a flat body with a back side, lateral sides, and a curved portion conforming to the curvature of a rear of a toilet bowl. The flat body includes a wall extending along a periphery of the flat body except for along the curved portion, defining a urine collecting portion therein. The urine collecting portion can be sloped to allow urine to flow to the toilet bowl.

8 Claims, 4 Drawing Sheets

TOILET SPLASH GUARD

CROSS-REFERENCE TO RELATED APPLICATIONS

This application claims the benefit of U.S. Provisional Application No. 63/172,884, filed on Apr. 9, 2021, the subject matter of which is incorporated herein by reference

TECHNICAL FIELD

The present disclosure relates to a toilet splash guard that attaches to a toilet bowl to capture errant urine.

BACKGROUND

Cleaning a toilet is a necessary task. It must be done frequently for sanitary purposes, of course, but there is no quick and easy cleaning method. Moreover, because of the shape and geometry of a toilet, it requires bending down and getting into awkward positions. To make matters worse, there may be urine on parts of the toilet and the floor next to the toilet. It can be difficult, or impossible, for many persons to clean in these areas. For example, a person who is disabled, elderly, or arthritic may not be able to bend down to scrub the dried urine from the flooring. Even those who are able may find it difficult. Such urine usually comes from males relieving themselves in a standing position and missing the bowl.

SUMMARY

A toilet splash guard collects errant urine from a male urinating in an upright position. The toilet splash guard attaches toward the rear top ledge of a toilet bowl in between the toilet seat and the bowl. The toilet splash guard has a substantially flat body with a backside, lateral sides, and a curved portion substantially conforming to the curvature of a rear top of a toilet bowl. The flat body includes a wall extending along a periphery of the flat body except for along the curved portion, defining a urine capture portion therein. The urine capture portion can be sloped to allow urine to flow to the toilet bowl.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
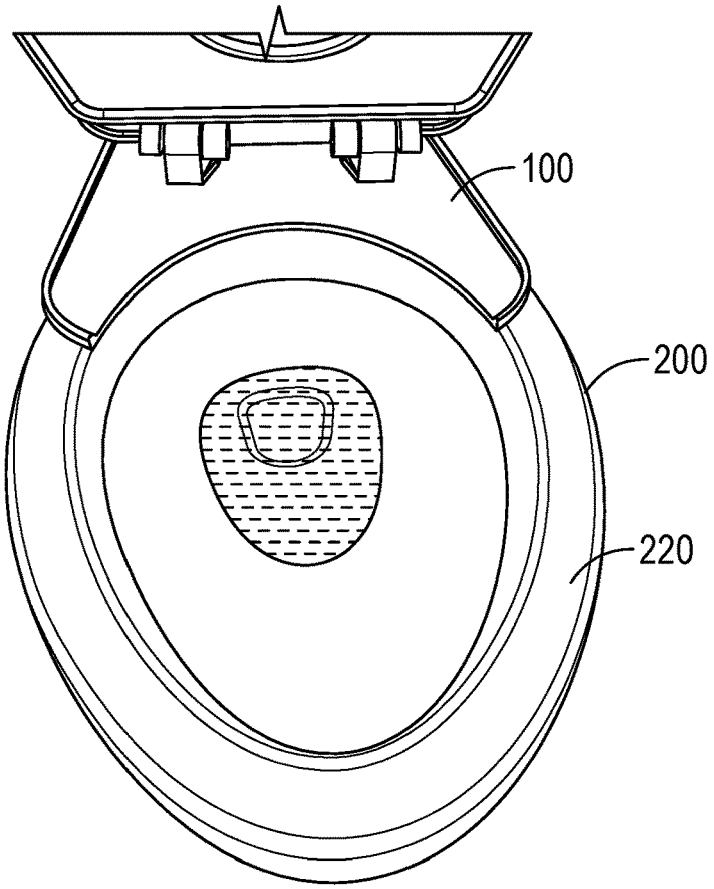
FIG. 1 shows a toilet splash guard attached to a toilet, according to an example embodiment of the disclosure.
Figure 2:
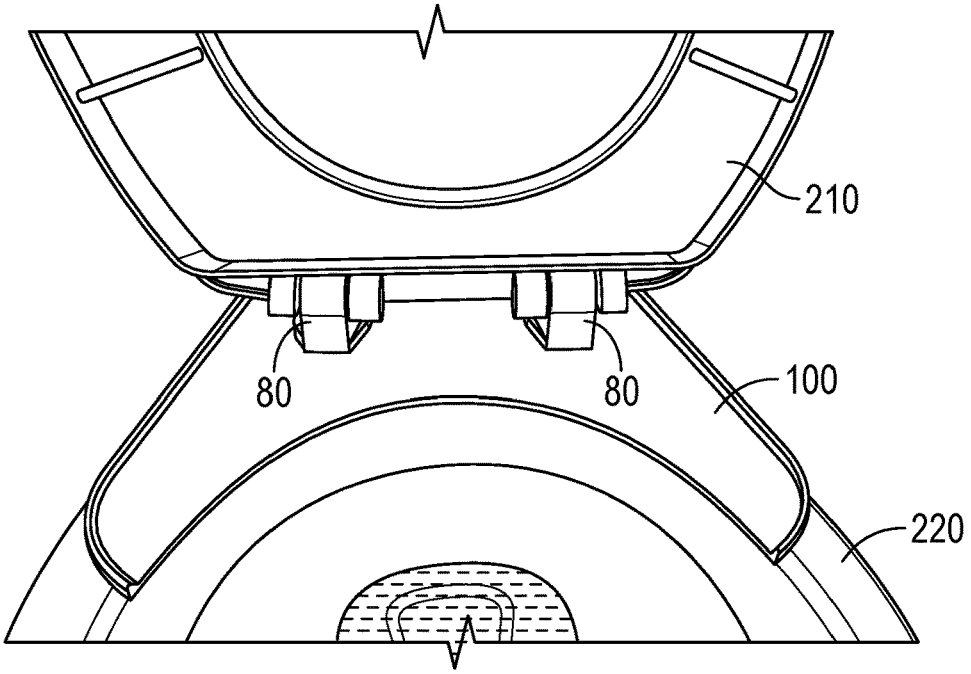
FIG. 2 shows a close-up of the toilet splash guard attached to the toilet, according to an example embodiment of the disclosure.

Referring to FIG. 1, an example toilet splash guard 100, according to an example embodiment of the disclosure, is illustrated. As shown, the toilet splash guard 100 is fitted to a top of a toilet bowl 200. More clearly shown in FIG. 2, the toilet splash guard 100 is disposed on top of the rear of a toilet bowl ledge 220, in between a toilet seat 210 and the toilet bowl ledge 220. Advantageously, the toilet splash guard 100 sticks out beyond the toilet bowl 200 and preferably extends to (or near) a front edge of toilet bowl tank to cover a wide area.

In operation, the toilet splash guard 100 captures errant urine preventing it from splashing onto the floor or elsewhere. Notably, the hard-to-clean area between the toilet seat 210 and bolts 80 can also be protected from urine deposits. The same bolts 80 that connect the toilet seat 210 to the toilet bowl 200 can be used to attach the toilet splash guard 100 (or a different set of bolts 80 may be used). That is, the bolts 80 can be shared with the toilet splash guard 100 such that the toilet splash guard 100 is sandwiched between the toilet seat 210 and the toilet bowl 200.

Figure 3:
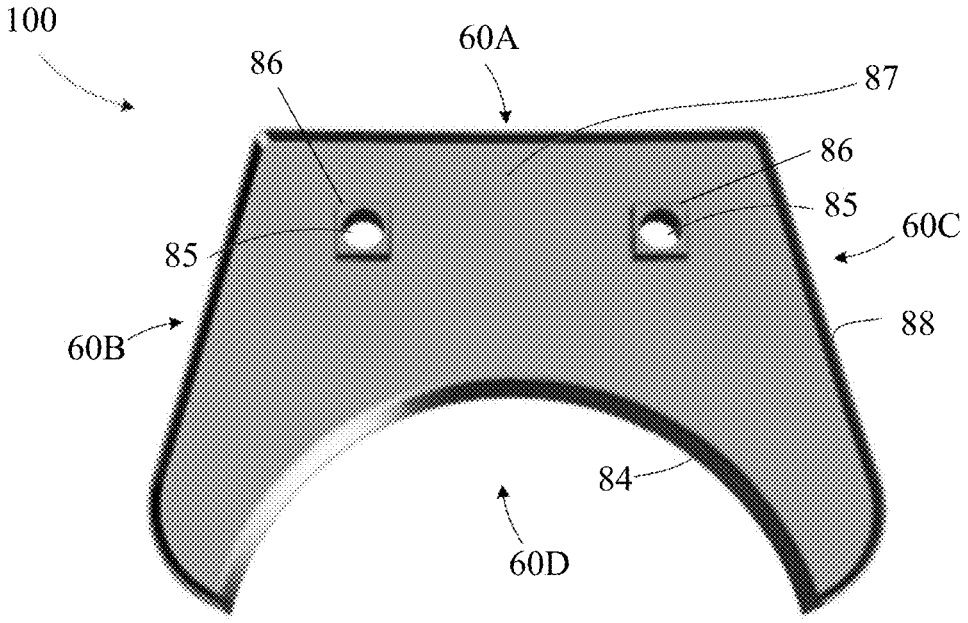
FIG. 3 shows a top view of the toilet splash guard, according to an example embodiment of the disclosure.

FIG. 3 shows a top view of the toilet splash guard 100. The body of the toilet splash guard 100 can be constructed of a single flat piece of a suitable durable material. The toilet splash guard 100 includes a curved side 84 that substantially conforms to the curvature of the toilet bowl ledge 220, lateral sides 60B and 60C which can be of a suitable shape to capture instances of urine spray, and a backside 60A that can be shaped to conform with the toilet tank (e.g., linear).

The toilet splash guard 100 further includes a urine capture portion 87 that can be a flat surface. However, preferably, the urine capture portion 87 will be downwardly sloped from the back side 60A to the curved side 84 to allow the urine collected in the urine capture portion 87 to flow into the toilet bowl 200. The urine capture portion 87 is preferably surrounded by a wall 88 to keep the collected urine from leaking out, except that there is no wall around the curved side 84. As mentioned, the urine capture portion 87 can be sloped to allow the urine to flow to the toilet bowl. As an example, the back of the toilet splash guard 100 can be elevated by about 0.25 inches relative to the front. The toilet splash guard 100 can be secured to the toilet bowl 200 using bolts disposed through bolt holes 85. As depicted, the bolt holes 85 include square-shaped raised portions 86 each of which is slightly elevated relative to the urine capture portion 87. It is to be understood that the raised portions 86 could be of a different shape (e.g., rectangular, circular, oval) and extend farther in any direction so as to provide additional support.

Figure 4:
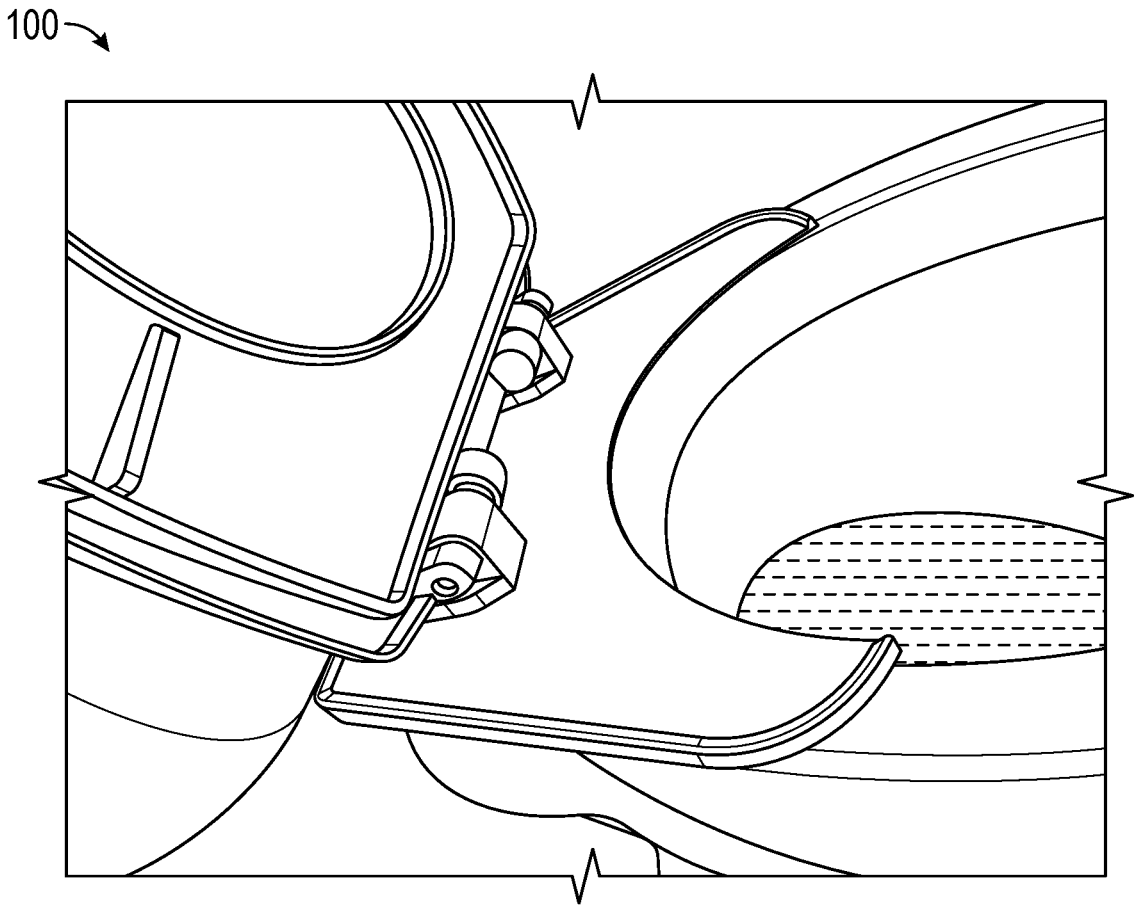
FIG. 4 shows a side perspective view of the toilet splash guard attached to the toilet, according to an example embodiment of the disclosure.

FIG. 4 shows a side perspective view of the toilet splash guard attached to the toilet bowl 200, according to an embodiment of the disclosure. Note that in this view, the toilet splash guard 100 can be seen extending to (or near) a front side of toilet bowl tank 95. It is to be understood, however, that not all toilets include a toilet bowl tank 95 (such as some used in public facilities), and, therefore, in those cases, the toilet splash guard 100 would still extend to the back of the toilet bowl 200.

Figure 5A:
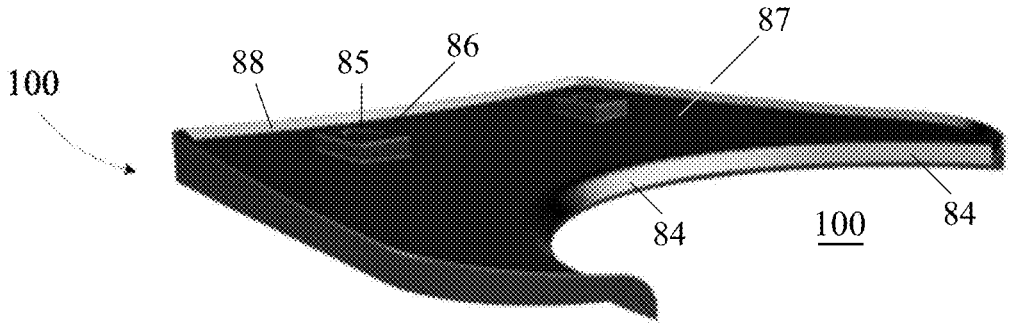
FIGS. 5A-5D show various views of the toilet splash guard, according to an example embodiment of the disclosure.
Figure 5B:
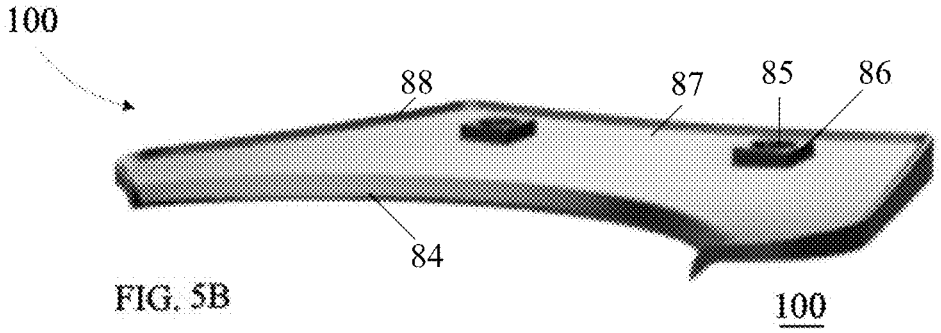
Figure 5C:
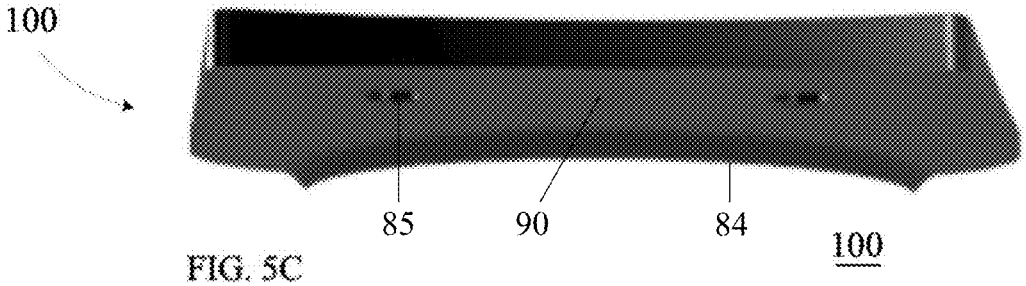
Figure 5D:
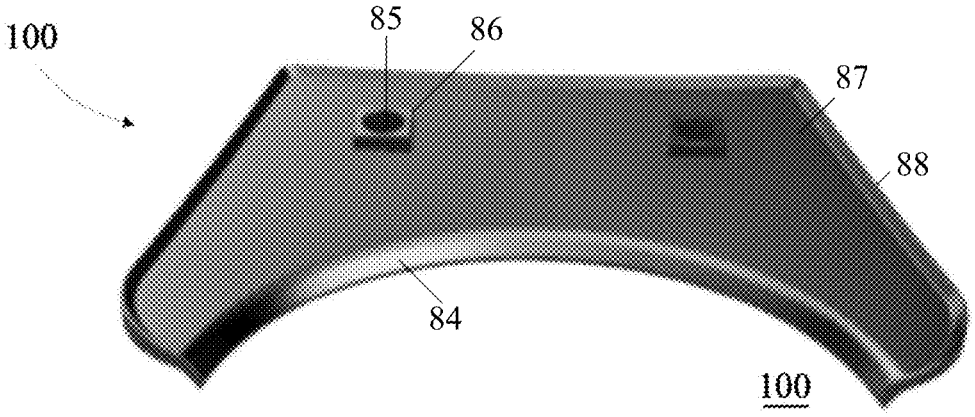

FIGS. 5A-5D show various views of the toilet splash guard 100, according to an example embodiment of the disclosure. In particular, FIG. 5A and FIG. 5B show the toilet splash guard 100 in perspective views highlighting left and right sides, respectively. FIG. 5C shows the toilet splash guard 100 lifted in such a way as to expose the bottom side 90. FIG. 5D shows a centered perspective view of the toilet splash guard 100.

Although the illustrated toilet bowl 200 has a particular size and oval shape (often referred to as an elongated toilet bowl), it is to be understood that the present disclosure is not limited to this type of toilet bowl. For instance, the toilet bowl used could have a round bowl shape, or it could accommodate a compact toilet such as those commonly used on an airplane or bus. As an example, the curved side 84 might be more rounded than the one illustrated if it were to fit a round toilet bowl. It is to be understood, therefore, that the shape and size of the toilet splash guard 100 may vary depending on the shape and size of the toilet bowl upon which it is to be fitted. Additionally, it is to be understood that the toilet seat 210 can be closed (as depicted) or have an open front (also called "split seat"). In general, the toilet splash guard 100 can be designed to fit any type of toilet bowl 100 and toilet seat 210. The toilet splash guard 100 can be used on toilets for home, office, or public usage. In the case of office or public usage, the type of materials chosen (and other design aspects) would be influenced by heavy usage considerations.

The toilet splash guard 100 can be constructed of various materials. Most preferably, the color of the material chosen matches the color used for the toilet seat 210. For instance, if the toilet seat 210 was made of a beige colored polypropylene, then the toilet splash guard 100 could be have the same color and the same or similar material. In general, the toilet splash guard 100 can be made of any suitable durable material, including polyresin, polypropylene, enameled wood, veneered wood, ceramic, and metal (e.g., stainless steel). The toilet splash guard 100 can also be made of a transparent material such as glass or transparent plastic. A translucent material such as frosted glass or tinted plastic can also be used.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A toilet splash guard, comprising:

a thin body having a back side, lateral sides, and a curved portion, the curved portion conforming substantially to a curvature of a toilet bowl;

wherein the thin body includes a pair of bolt holes to accommodate a respective pair of bolts;

wherein the lateral sides extend beyond the toilet bowl when the toilet splash guard is attached to the toilet bowl forming a urine capture portion which has a continuous, substantially flat surface; and wherein the bolt holes are each surrounded by a raised portion.

2. The toilet splash guard of claim 1, wherein the urine capture portion is bounded by a wall extending along a periphery thereof except for the curved portion.

3. The toilet splash guard of claim 1, wherein the back side is substantially linear.

4. The toilet splash guard of claim 1, wherein the urine capture portion is sloped downwardly toward the curved portion to allow urine collected in the urine capture portion to flow into the toilet bowl.

5. The toilet splash guard of claim 1, wherein the thin body is a single piece.

6. The toilet splash guard of claim 1, wherein the back side is adjacent a tank of a toilet having a tank when installed thereon.

7. The toilet splash guard of claim 1, wherein the curvature of the curved portion corresponds to a round toilet seat.

8. The toilet splash guard of claim 1, wherein the curvature of the curved portion corresponds to an elongated toilet seat.

* * * * *